US006522193B2

(12) United States Patent
Shin

(10) Patent No.: US 6,522,193 B2
(45) Date of Patent: Feb. 18, 2003

(54) INTERNAL VOLTAGE GENERATOR FOR SEMICONDUCTOR MEMORY DEVICE

(75) Inventor: Yoon Cherl Shin, Chungchongbuk-do (KR)

(73) Assignee: Hynix Semiconductor Inc., Ichon-shi (KR)

( * ) Notice: Subject to any disclaimer, the term of this patent is extended or adjusted under 35 U.S.C. 154(b) by 0 days.

(21) Appl. No.: 10/020,576

(22) Filed: Dec. 18, 2001

(65) Prior Publication Data

US 2002/0089370 A1 Jul. 11, 2002

(30) Foreign Application Priority Data

Dec. 19, 2000 (KR) ..... 2000-78453
Dec. 7, 2001 (KR) ..... 2001-77213

(51) Int. Cl.[7] ..... G05F 1/10
(52) U.S. Cl. ..... 327/536
(58) Field of Search ..... 327/77, 88, 142, 327/143, 534, 535, 536

(56) References Cited

U.S. PATENT DOCUMENTS 5,912,571 A * 6/1999 Li et al. ..... 327/143
6,160,431 A * 12/2000 Crotty ..... 327/143
6,363,025 B1 * 3/2002 McLaury ..... 327/143

* cited by examiner

*Primary Examiner*—Jeffrey Zweizig
(74) *Attorney, Agent, or Firm*—Jacobson Holman PLLC

(57) ABSTRACT

An internal voltage generator for a semiconductor memory device prevents generation of an internal voltage from being delayed, by generating a ramp-up voltage higher than a low external power voltage in an initial power-up operation, when the low external power voltage is supplied to the semiconductor memory device. The internal voltage generator for the semiconductor memory device includes: a control signal generating circuit for generating first and second control signals for controlling generation of a ramp-up voltage; a ramp-up voltage generating circuit for generating a ramp-up voltage higher than the low external power voltage in response to the first and second control signals; a switching circuit switched in response to the second control signal, and selectively transmitting the ramp-up voltage and the low external power voltage; and an internal voltage generating circuit for selectively receiving the ramp-up voltage and the low external power voltage from the switching circuit, and generating a plurality of internal voltages.

14 Claims, 13 Drawing Sheets

<Prior Art>

<Prior Art>

<Prior Art>

INTERNAL VOLTAGE GENERATOR FOR SEMICONDUCTOR MEMORY DEVICE

BACKGROUND OF THE INVENTION

1. Field of the Invention

The present invention relates to an internal voltage generator for a semiconductor memory device, and in particular to an internal voltage generator for improving an initial power-up operation property of a semiconductor memory device under a low external power voltage.

2. Description of the Background Art

In the conventional art, when a low external power voltage is supplied to a semiconductor memory device, generation of an internal voltage in an initial power-up operation is delayed, and thus operation of the whole system is also delayed. This results in a mis-operation of the system.

Referring to FIG. 1, a conventional internal voltage generator includes: a control signal generator 1 for generating a control signal C0 by using a general external power voltage VDD-1; and an internal voltage generating circuit 2 for generating internal voltages Vref-1, Vint-1 and Vint2-1 in response to the control signal C0.

The disadvantages of the conventional internal voltage generator will be explained in detail with reference to FIGS. 2 and 3.

FIG. 2 is a timing diagram of the initial power-up operation in a state where the general external power voltage is supplied to the semiconductor memory device. FIG. 3 is a timing diagram of the initial power-up operation in a state where the low external power voltage is supplied to the semiconductor memory device.

In FIGS. 2 and 3, VDD-1 denotes the general external power voltage, and VDD denotes the low external power voltage. Vref-1 denotes the reference voltage for internal power generated by VDD-1, and Vref denotes a reference voltage for internal power generated by VDD. Vint-1 denotes the first internal voltage generated according to Vref-1, and Vint denotes a first internal voltage generated according to Vref. Vint2-1 denotes a second internal voltage generated by Vint-1, and Vint2 denotes a second internal voltage generated by Vint2. A represents the time point when the first internal voltages Vint and Vin-1 reach an aimed voltage level. B represents the time point when the second internal voltages Vint2 and Vint2-1 reach an aimed voltage level.

As illustrated in FIG. 3, when the low external power voltage is supplied to the semiconductor memory device, the reference voltage Vref for internal power is delayed due to the low voltage in the initial power-up operation, thereby delaying the generation of the first internal voltage Vint and the second internal voltage Vint2 (t1 denotes a time when the external power voltage reaches the aimed voltage level, and t2 denotes a specification value of the second internal voltage Vint2 which is finally generated) . As a result, the generation time of the second internal power voltage Vint2 exceeds the aimed voltage reaching time t2.

SUMMARY OF THE INVENTION

Accordingly, it is an object of the present invention to prevent generation of an internal voltage from being delayed in an initial power-up operation, by generating a ramp-up voltage higher than a low external power voltage, if the low external power voltage is supplied to a semiconductor memory device.

In order to achieve the above-described object of the invention, there is provided a first embodiment of an internal voltage generator for a semiconductor memory device. The internal voltage generator comprises a control signal generator, a ramp-up voltage generator, a switching circuit, and an internal voltage generating circuit. The control signal generator generates first and second control signals for controlling generation of a ramp-up voltage. The ramp-up voltage generator generates a ramp-up voltage higher than a low external power voltage in response to the first and second control signals. The switching circuit selectively transmits either the ramp-up voltage or the low external power voltage in response to the second control signal. The internal voltage generating circuit selectively receives either the ramp-up voltage or the low external power voltage from the switching circuit, and generates a plurality of internal voltages.

In addition, there is provided a second embodiment of an internal voltage generator for a semiconductor memory device. The internal voltage generator comprises first to fourth control signal generators, first and second ramp-up voltage generators, first and second switching circuits, and an internal voltage generating circuit. The first control signal generator generates first and second control signals for controlling generation of a first ramp-up voltage. The second control signal generator generates a third control signal for controlling generation of a second ramp-up voltage and a high voltage. The third control signal generator receives and synthesizes the second control signal and the third control signal, and generates a fourth control signal for controlling generation of the second ramp-up voltage and the high voltage. The first ramp-up voltage generator generates the first ramp-up voltage higher than the low external power voltage in response to the first control signal. The second ramp-up voltage generator generates the second ramp-up voltage and the high voltage higher than the low external power voltage in response to the second control signal and the fourth control signal. The first switching circuit is switched according to the second control signal, and for selectively transmitting either the second ramp-up voltage or the high voltage. The second switching circuit is switched according to the second control signal, and for selectively transmitting either the first and second ramp-up voltages or the low external power voltage. The internal voltage generating circuit selectively receives either the first and second ramp-up voltages or the low external power voltage from the second switching circuit, and generates a plurality of internal voltages. The fourth control signal generator receives one of the plurality of internal voltages, and generates a fifth control signal for deciding a level of the second control signal.

BRIEF DESCRIPTION OF THE DRAWINGS

The inventions claimed herein will be explained and supported by the following detailed description when read in conjunction with the accompanying drawings in which:

DETAILED DESCRIPTION OF THE PREFERRED EMBODIMENTS

An internal voltage generator for a semiconductor memory device in accordance with preferred embodiments of the present invention will now be described in detail with reference to the accompanying drawings.

Figure 1:
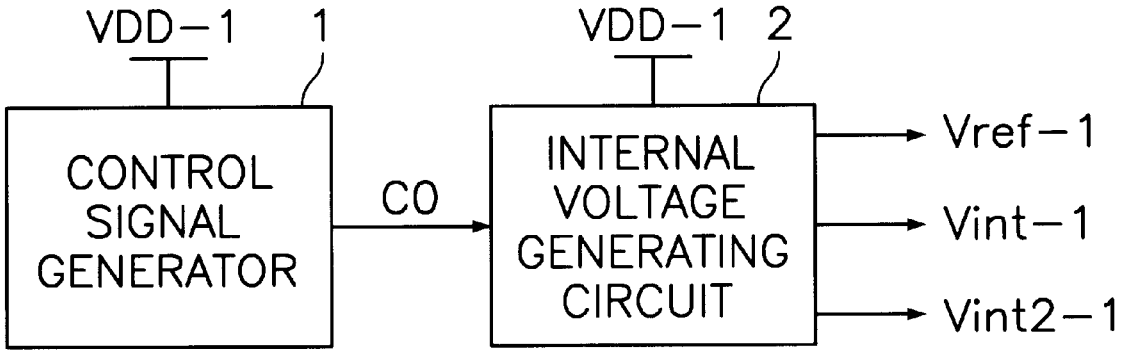
FIG. 1 is a block diagram illustrating a conventional internal voltage generator for a semiconductor memory device.
Figure 2:
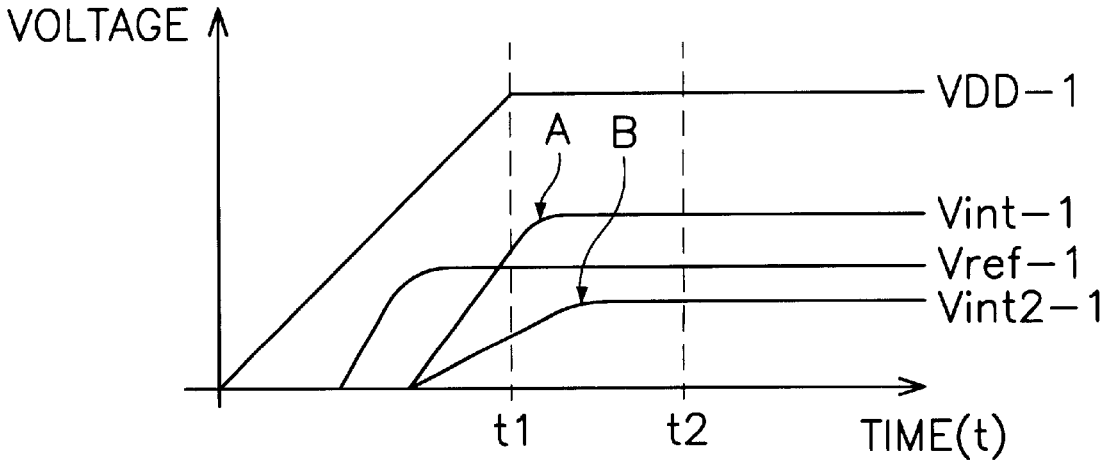
FIG. 2 is a timing diagram of an initial power-up operation in a state where a general external power voltage is supplied to the conventional semiconductor memory device.
Figure 3:
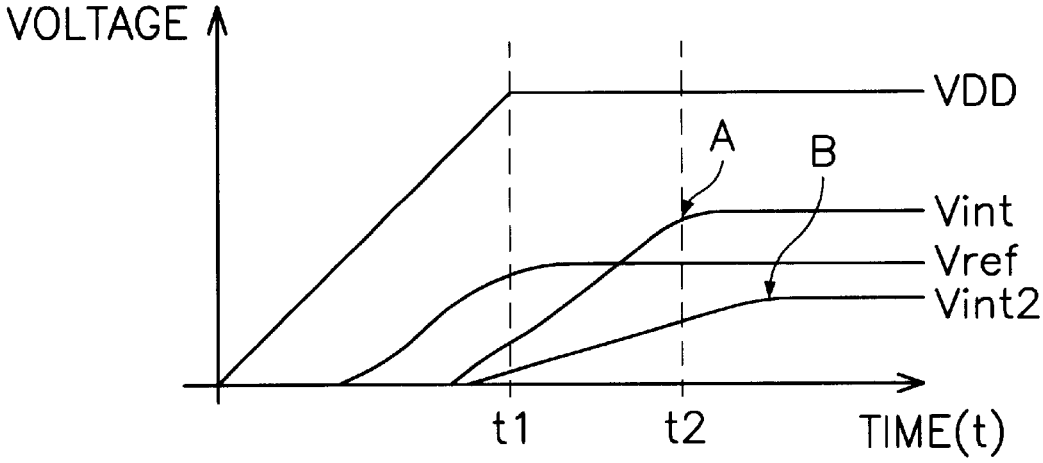
FIG. 3 is a timing diagram of an initial power-up operation in a state where a low external power voltage is supplied to the conventional semiconductor memory device.
Figure 4:
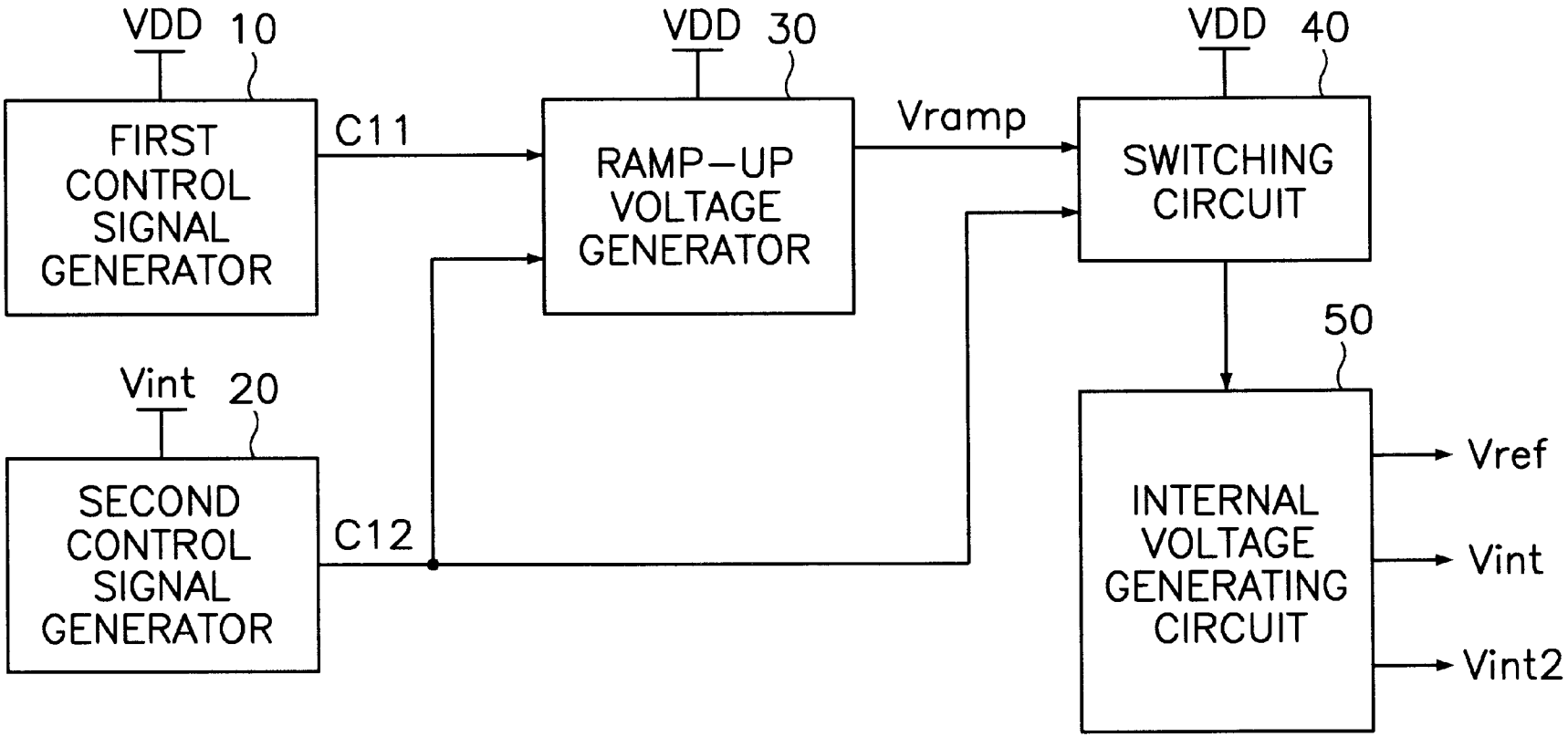
FIG. 4 is a block diagram illustrating an internal voltage generator for a semiconductor memory device in accordance with a first embodiment of the present invention.

FIG. 4 is a block diagram illustrating an internal voltage generator for a semiconductor memory device in accordance with a first embodiment of the present invention, for preventing delay of internal voltage generation by generating a new internal voltage (hereinafter, referred to as 'ramp-up voltage') higher than a low external power voltage in an initial power-up operation, if the low external power voltage is supplied to the semiconductor memory device.

Referring to FIG. 4, the internal voltage generator in accordance with the first embodiment of the present invention includes: first and second control signal generators 10 and 20; a ramp-up voltage generator 30; a switching circuit 40 and an internal voltage generating circuit 50.

The first control signal generator 10 generates a first control signal Cll for controlling generation of a ramp-up voltage Vramp, by using a low external power voltage VDD. The second control signal generator 20 generates a second control signal C12 for controlling generation of the ramp-up voltage Vramp, by using an internal power voltage Vint. The ramp-up voltage generator 30 generates the ramp-up voltage Vramp higher than the low external power voltage VDD in response to the first and second control signals C11 and C12. The switching circuit 40 transmits either the ramp-up voltage Vramp or the low external power voltage VDD under the control of the second control signal C12. The internal voltage generating circuit 50 selectively receives either the ramp-up voltage Vramp or the low external power voltage VDD from the switching circuit 40, and generates a reference voltage Vref for internal power, a first internal voltage Vint and a second internal voltage Vint2.

The construction of the respective units of FIG. 4 will now be described in detail with reference to FIGS. 5 to 8.

Figure 5:
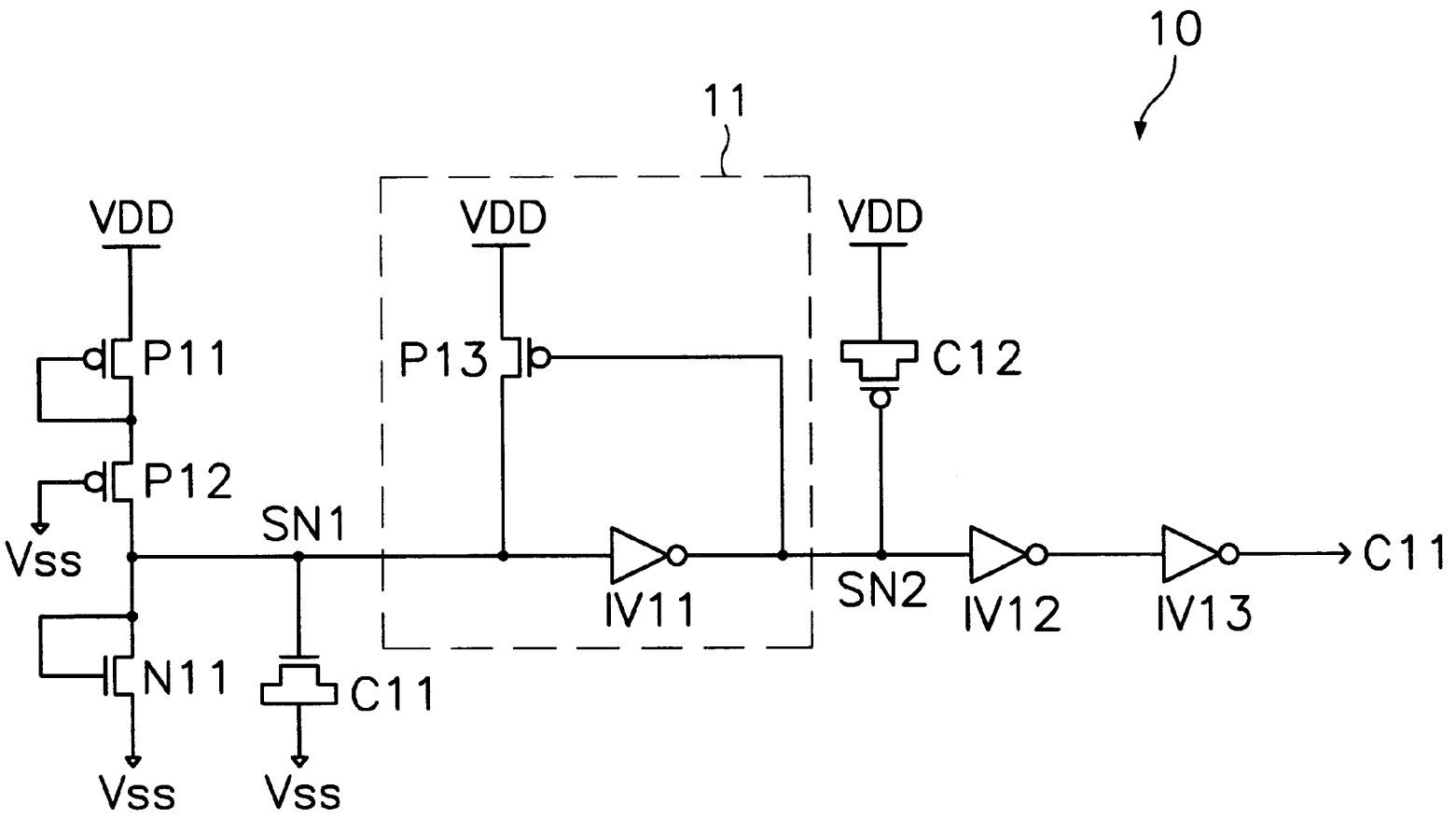
FIG. 5 is a circuit diagram illustrating a first control signal generator of FIG. 4.

In the first control signal generator 10 of FIG. 5, a PMOS transistor P11 has its source connected to the low power voltage VDD, and its gate and drain commonly connected. A PMOS transistor P12 has its source connected to the gate and drain of the PMOS transistor P11, and its gate connected to a ground voltage Vss. An NMOS transistor N11 has its source connected to the ground voltage Vss, its gate and drain commonly connected with each other, and its drain connected to the drain of the PMOS transistor P12. An NMOS capacitor C11 is connected between a node SN1 and the ground voltage Vss. A latch circuit 11 is connected between the node SN1 and a node SN2. A PMOS capacitor C12 is connected between the node SN2 and the low power voltage VDD. An inverter IV12 and an inverter IV13 invert a signal of the node SN2, and output the first control signal C11. Here, the latch circuit 11 includes: an inverter IV11 for inverting a signal of the node SN1; and a PMOS transistor P13 having its source connected to the low power voltage VDD, its drain connected to the node SN1, and its gate connected to receive the output signal from the inverter IV11.

Figure 6:
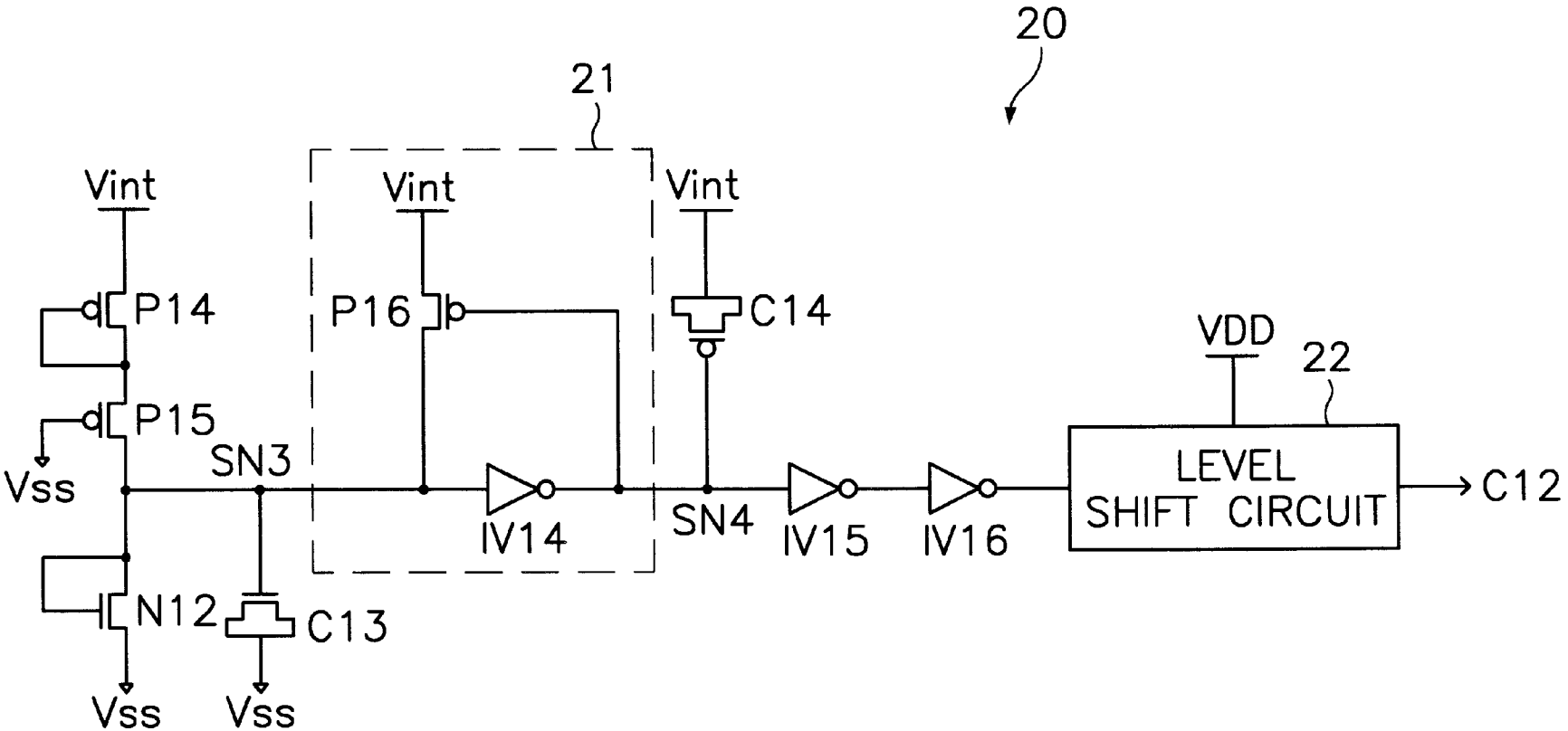
FIG. 6 is a circuit diagram illustrating a second control signal generator of FIG. 4.

In the second control signal generator 20 of FIG. 6, a PMOS transistor P14 has its source connected to the internal power voltage Vint, and its gate and drain commonly connected with each other. A PMOS transistor P15 has its source connected to the gate and drain of the PMOS transistor P14, and its gate connected to the ground voltage Vss. An NMOS transistor N12 has its source connected to the ground voltage Vss, its gate and drain commonly connected with each other, and its drain connected to the drain of the PMOS transistor P15. An NMOS capacitor C13 is connected between a node SN3 and the ground voltage Vss. A latch circuit 21 is connected between the node SN3 and a node SN4. A PMOS capacitor C14 is connected between the node SN4 and the internal power voltage Vint. An inverter IV12 and an inverter IV13 invert a signal of the node SN2, and output the inverted signal. A level shift circuit 22 level-shifts the output signal from an inverter IV16 and generates the second control signal C12. Here, the latch circuit 21 includes: an inverter IV14 for inverting a signal of the node SN3; and a PMOS transistor P16 having its source connected to the internal power voltage Vint, its drain connected to the node SN4, and its gate connected to receive the output signal from the inverter IV14.

Figure 7:
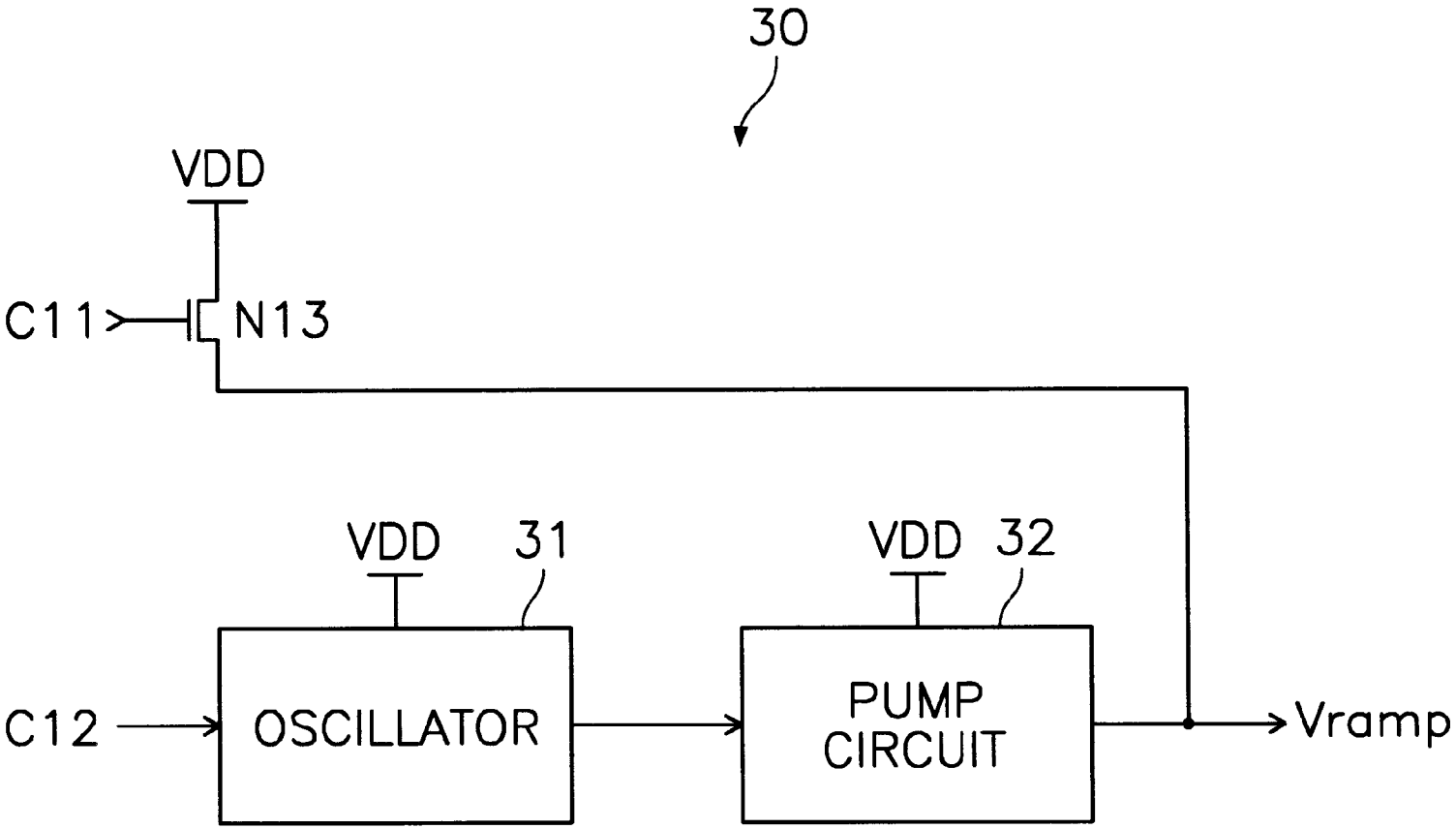
FIG. 7 is a circuit diagram illustrating a ramp-up voltage generator of FIG. 4.

The ramp-up voltage generator 30 of FIG. 7 includes: an NMOS transistor N13 having its source connected to the low external power voltage VDD, its drain connected to an output terminal, and its gate connected to receive the first control signal C11 from the first control signal generator 10; an oscillator 31 operated in response to the second control signal C12; and a pump circuit 32 for pumping the output signal from the oscillator 31 and generating the ramp-up voltage Vramp.

The NMOS transistor N13 is turned on according to the first control signal C11 having a high level, for shorting the ramp-up voltage Vramp to the low external power voltage VDD, so that the ramp-up voltage Vramp can follow the low external power voltage VDD. In a period when the first control signal C11 has a high level, the second control signal C12 has a high level, but the external power voltage VDD is low. Accordingly, the oscillator 31 and the pump circuit 32 are not normally operated, and thus the ramp-up voltage Vramp maintains VDD-Vt (threshold voltage of the NMOS transistor N13).

Thereafter, when the low external power voltage VDD is raised to a certain extent, the oscillator 31 and the pump circuit 32 perform a normal operation, and the first control signal C11 has a low level, thereby turning off the NMOS transistor N13. Therefore, the ramp-up voltage Vramp is increased over the low external power voltage VDD by the operation of the oscillator 31 and the pump circuit 32. When the second control signal C12 has a low level, the oscillator 31 and the pump circuit 32 stop the operation, and the ramp-up voltage vramp has a level of the ground voltage.

Figure 8:
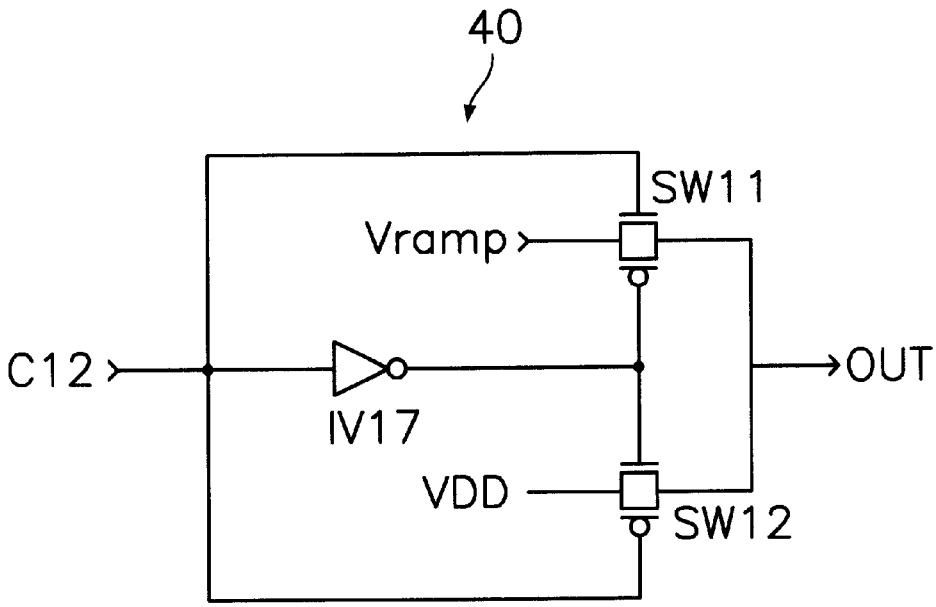
FIG. 8 is a circuit diagram illustrating a switching circuit of FIG. 4.

The switching circuit 40 of FIG. 8 includes: an inverter IV17 for inverting the second control signal C12 from the second control signal generator 20; and first and second switching devices SW11 and SW12 switched under the control of the second control signal C12 and the output signal from the inverter IV17, for transmitting the ramp-up voltage Vramp and the low power voltage VDD.

The switching circuit 40 transmits the ramp-up voltage Vramp when the second control signal C12 has a high level, and transmits the power voltage VDD when the control signal C12 has a low level (namely, the ramp-up voltage Vramp has a level of the ground voltage).

The internal voltage generating circuit 50 receives the ramp-up voltage Vramp from the switching circuit 40 in the power-up operation, and generates the internal voltages Vref, Vint and Vint2.

Accordingly, the internal voltages Vref, Vint and Vint2 are generated by using the ramp-up voltage Vramp, thereby removing a delay due to the low voltage.

Figure 9:
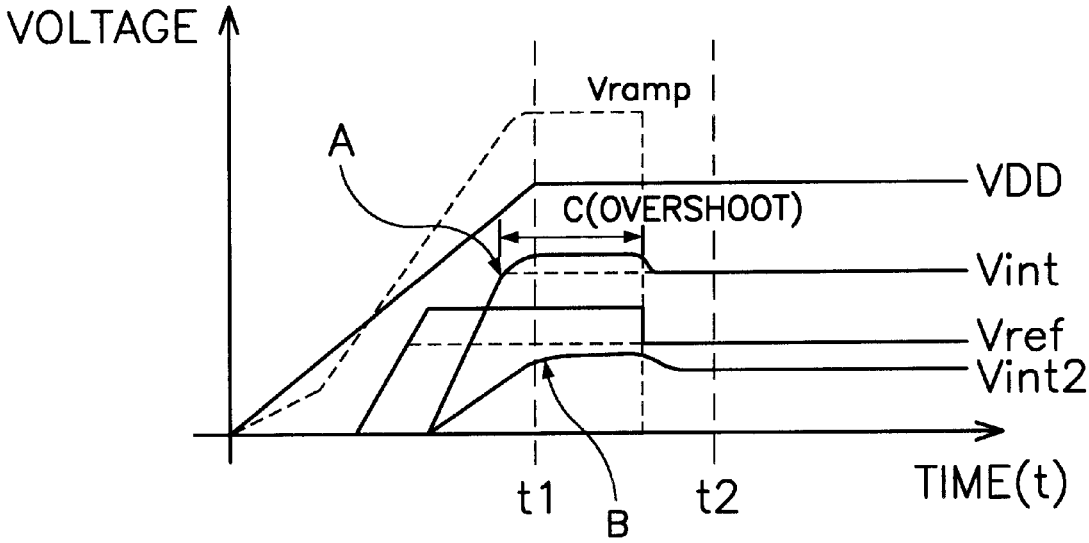
FIG. 9 is a timing diagram of an initial power-up operation in a state where a low external power voltage is supplied to the semiconductor memory device in accordance with the present invention.

FIG. 9 is a timing diagram of the low external power voltage VDD and the ramp-up voltage Vramp in the initial power-up operation in a state where the low external power voltage VDD is supplied to the semiconductor memory device.

Referring to FIG. 9, VDD denotes the low external power voltage, Vramp denotes the ramp-up voltage generated by using VDD, Vref denotes the reference voltage for internal power generated by receiving Vramp, Vint denotes the first internal voltage generated according to Vref, and Vint2 denotes the second internal voltage generated by receiving Vint.

A and B respectively represent time points when the first internal voltage Vint and the second internal voltage Vint2 reach an aimed voltage level. C denotes an overshoot period. In the overshoot period, it is possible to remove the delay generated when Vint2 is generated from Vint.

As illustrated in FIG. 9, when the low external power voltage VDD is supplied to the semiconductor memory device, the ramp-up voltage Vramp higher than the low external power voltage VDD is generated in the power-up operation, thereby preventing the delay of the internal voltage generation. Therefore, the reference voltage Vref for internal power is generated by using the ramp-up voltage Vramp, the first internal voltages Vint is generated by using the reference voltage Vref, and the second internal voltage Vint2 is generated by using the first internal voltages Vint. As a result, the reference voltage Vref and first and the second internal voltages Vint and Vint2 are generated within an aimed voltage reaching time t2.

Here, t1 denotes a time when the low external power voltage reaches an aimed voltage level, and t2 denotes a specification value of the time when the second internal voltage Vint2 reaches an aimed voltage level.

Figure 10:
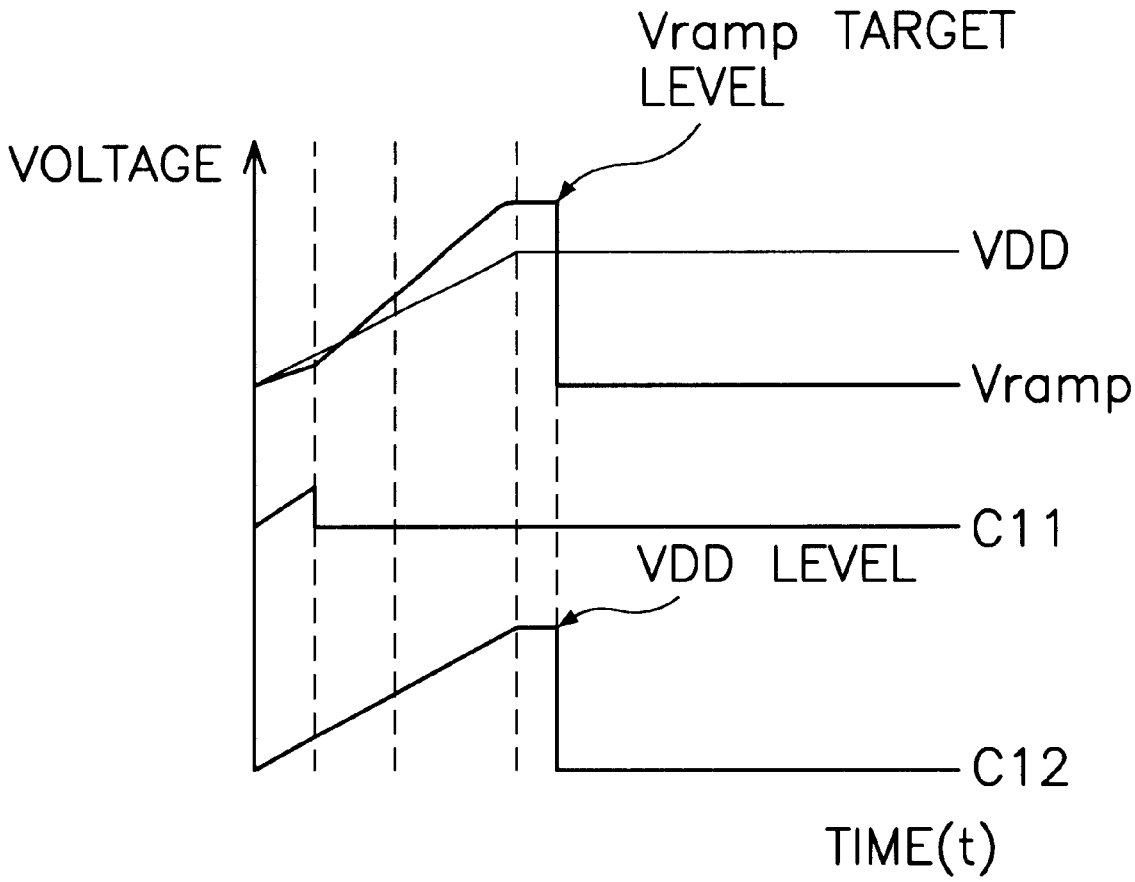
FIG. 10 is a timing diagram of signals of FIG. 4.

On the other hand, FIG. 10 is a timing diagram of the major signals of FIG. 4. As shown in FIG. 10, the second control signal C12 becomes a low level with a predetermined delay (margin).

Accordingly, the ramp-up voltage Vramp higher than the low external power voltage VDD is generated by using the first and second control signals C11 and C12, and the internal voltages Vref, Vint and Vint2 are generated by using the ramp-up voltage Vramp, to remove the delay due to the low voltage.

Figure 11:
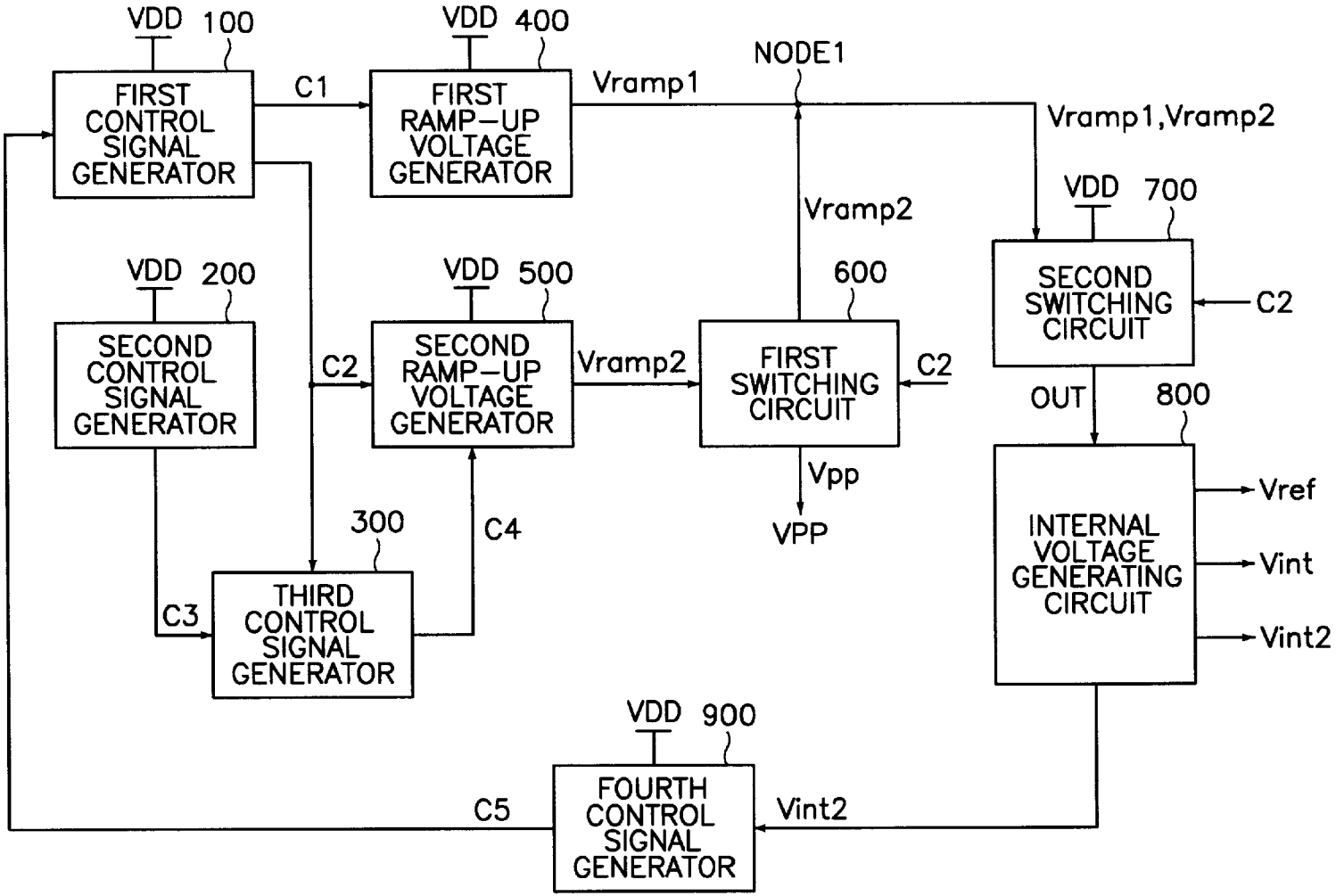
FIG. 11 is a block diagram illustrating an internal voltage generator for a semiconductor memory device in accordance with a second embodiment of the present invention.

FIG. 11 is a block diagram illustrating an internal voltage generator for a semiconductor memory device in accordance with a second embodiment of the present invention, including: first to fourth control signal generators 100, 200, 300 and 900; first and second ramp-up voltage generators 400 and 500; first and second switching circuits 600 and 700; and an internal voltage generating circuit 800.

The first control signal generator 100 generates first and second control signals C1 and C2 for controlling generation of a first ramp-up voltage. The second control signal generator 200 generates a third control signal C3 for controlling generation of a second ramp-up voltage and a high voltage Vpp. The third control signal generator 300 receives and synthesizes the second control signal C2 and the third control signal C3, and then generates a fourth control signal C4. The first ramp-up voltage generator 400 receives the low external power voltage VDD and generates the first ramp-up voltage Vrampl higher than the low external power voltage VDD in response to the first control signal C1. The second ramp-up voltage generator 500 receives the low external power voltage VDD, and generates the second ramp-up voltage higher than the low external power voltage VDD and the high voltage in response to the second control signal C2 and the fourth control signal C4. The first switching circuit 600 is switched according to the second control signal C2, and selectively transmits either the second ramp-up voltage Vramp2 or the high voltage Vpp. The second switching circuit 700 is switched according to the second control signal C2, and selectively transmits either the first and second ramp-up voltages Vramp1 and Vramp2 or the low external power voltage VDD. The internal voltage generating circuit 800 selectively receives either the first and second ramp-up voltages Vramp1 and Vramp2 or the low external power voltage VDD from the second switching circuit 700, and generates a reference voltage Vref for internal power, a first internal voltage Vint and a second internal voltage Vint2. The fourth control signal generator 900 receives the second internal voltage Vint2 from the internal voltage generating circuit 800, and generates a fifth control signal C5 for deciding a level of the second control signal C2.

Here, the second ramp-up voltage generator 500 exclusively uses a regulator for high voltage Vpp and a pump, and the fourth control signal generator 900 uses a voltage sensing circuit and a delay circuit.

Figure 12:
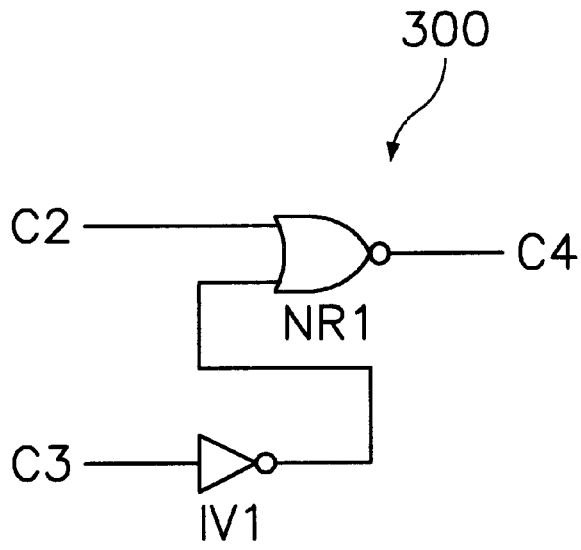
FIG. 12 is a circuit diagram illustrating a third control signal generator of FIG. 11.

FIG. 12 is a circuit diagram illustrating the third control signal generator 300 of FIG. 11. The third control signal generator 300 includes: an inverter IV1 for receiving the third control signal C3 from the second control signal generator 200, and inverting the received signal; and a NOR gate NR1 for NORing the second control signal C2 from the first control signal generator 100 and the output signal from the inverter IV1, and generating the fourth control signal C4.

In the third control signal generator 300, when the second control signal C2 has a high level, the fourth control signal C4 is disabled in a low level. When the second control signal C2 has a low level, the fourth control signal C4 is operated according to a level of the third control signal C3.

The construction and operation of the first and second ramp-up voltage generators 400 and 500 will now be explained.

Figure 13:
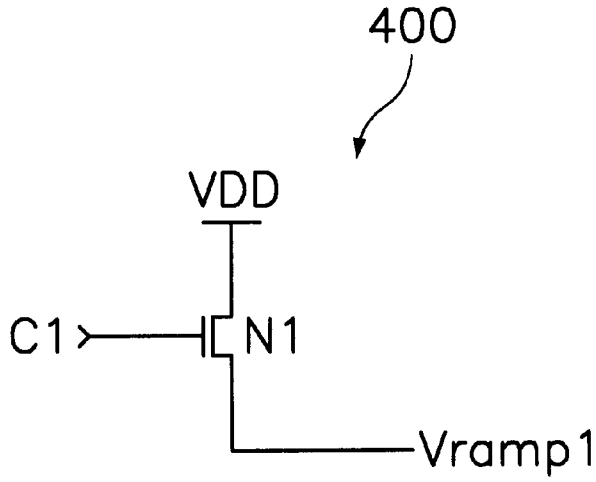
FIG. 13 is a circuit diagram illustrating a first ramp-up voltage generator of FIG. 11.

FIG. 13 is a circuit diagram illustrating the first ramp-up voltage generator 400 of FIG. 11. The first ramp-up voltage generator 400 includes an NMOS transistor N1 having its source connected to the low external power voltage VDD, and its gate connected to receive the first control signal C1 from the first control signal generator 100. The NMOS transistor N1 has a threshold voltage Vt having a low level.

Here, the first ramp-up voltage generator 400 generates the first ramp-up voltage Vramp1 higher than the low external power voltage VDD by using the low external power voltage VDD under the control of the first control signal C1. That is, the first ramp-up voltage generator 400 generates the first ramp-up voltage Vramp1 by using the low external power voltage VDD in response to the first control signal C1 having a high level. When the first control signal C1 becomes a low level after a predetermined time, the first ramp-up voltage generator 400 is not operated.

When receiving the second control signal C2 having a high level and the fourth control signal C4 having a low level, the second ramp-up voltage generator 500 of FIG. 11 is enabled. When the low external power voltage VDD is increased over the threshold voltage Vt of the circuit, the second ramp-up voltage generator 500 is operated to generate the second ramp-up voltage Vramp2 higher than the low external power voltage VDD. The second ramp-up voltage Vramp2 is supplied to the internal voltage generating circuit 800 through the second switching circuit 700. Conversely, when receiving the second control signal C2 having a low level and the fourth control signal C4 having a high level, the second ramp-up voltage generator 500 generates the high voltage Vpp. Here, the high voltage Vpp is supplied to a high voltage generating circuit VPP through the first switching circuit 600.

The construction and operation of the first and second switching circuits 600 and 700 will now be explained.

Figure 14:
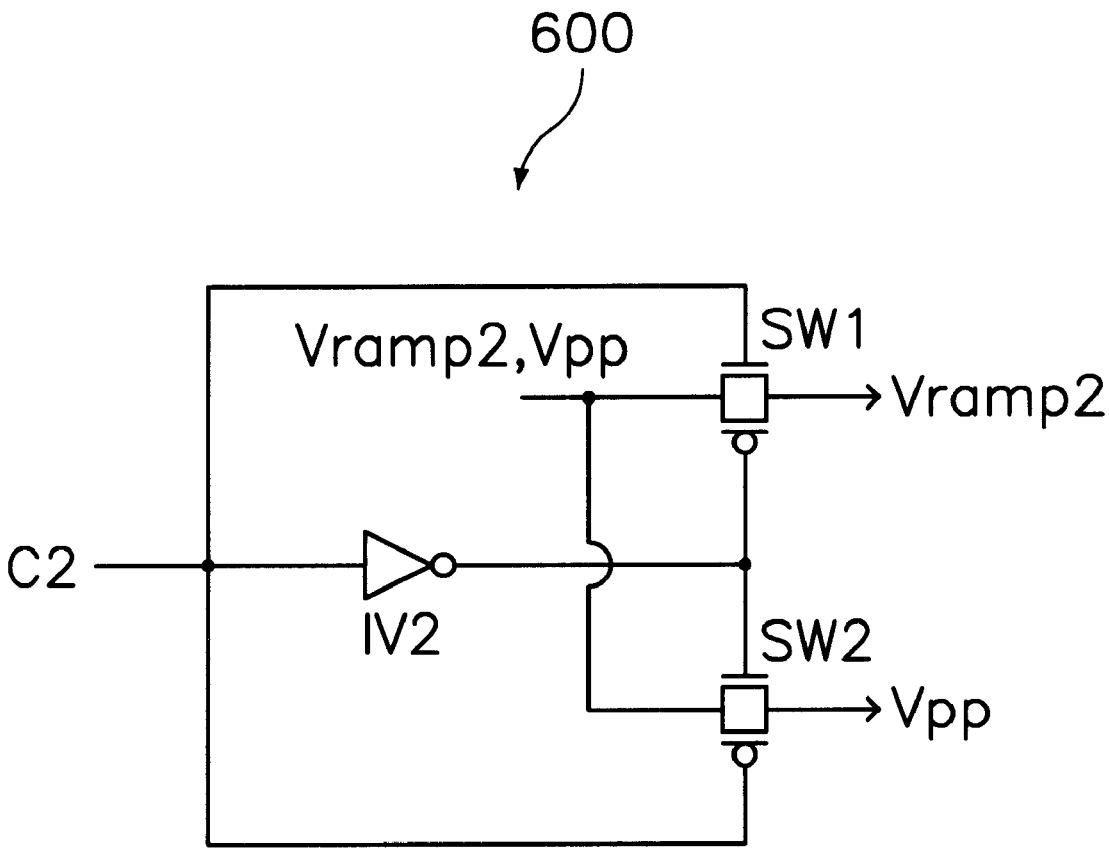
FIG. 14 is a circuit diagram illustrating a first switching circuit of FIG. 11.

FIG. 14 is a circuit diagram illustrating the first switching circuit 600 of FIG. 11. The first switching circuit 600 includes an inverter IV2 for inverting the second control signal C2 from the first control signal generator 100. First and second switching devices SW1 and SW2 are switched according to the second control signal C2 and the output signal from the inverter IV2, and for transmitting either the second ramp-up voltage Vramp2 or the high voltage Vpp.

The first switching circuit 600 transmits the second ramp-up voltage Vramp2 to a node 1 when receiving the high level control signal C2, and transmits the high voltage Vpp to the high voltage generating circuit VPP when receiving the low level control signal C2.

Figure 15:
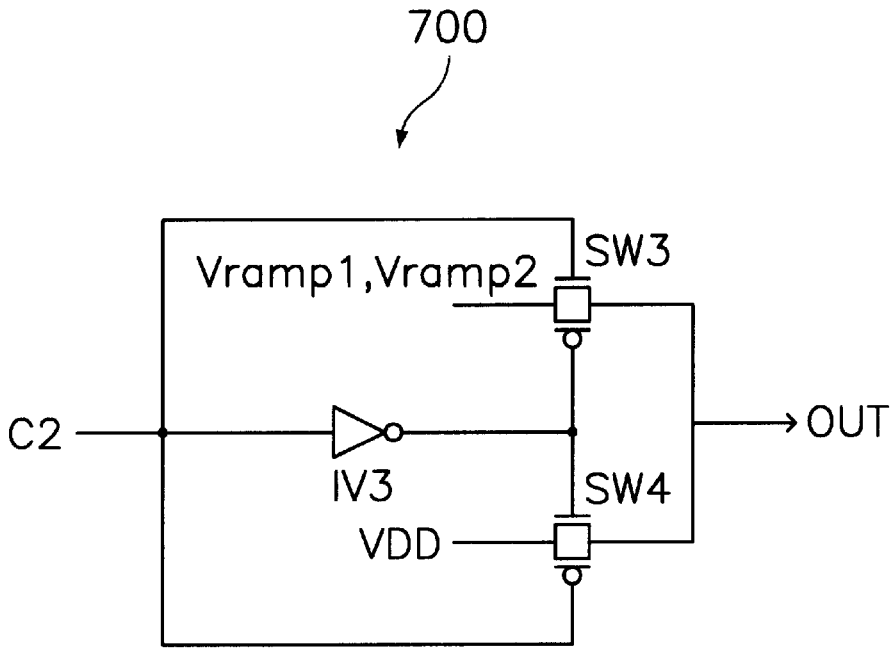
FIG. 15 is a circuit diagram illustrating a second switching circuit of FIG. 11.

FIG. 15 is a circuit diagram illustrating the second switching circuit 700 of FIG. 11. The second switching circuit 700 includes an inverter IV3 for inverting the second control signal C2. A third switching device SW3 is switched according to the second control signal C2 and the output signal from the inverter IV3, and transmits the first and second ramp-up voltages Vramp1 and Vramp2. A fourth switching device SW4 is switched according to the second control signal C2 and the output signal from the inverter IV3, and transmits the low external power voltage VDD.

The second switching circuit 700 supplies the first and second ramp-up voltages Vramp1 and Vramp2 higher than the low external power voltage VDD to the internal voltage generating circuit 800.

Thereafter, the internal voltage generating circuit 800 receives the first and second ramp-up voltages Vramp1 and Vramp2 from the second switching circuit 700 in the power-up operation, and generates the internal voltages Vref, Vint and Vint2, thereby removing the delay due to the low voltage (the first ramp-up voltage Vramp1 is lower than the low external power voltage VDD but has a predetermined voltage, namely VDD-Vt to rapidly increase the second ramp-up voltage Vramp2. Vt denotes a threshold voltage of the NMOS transistor N1).

The fourth control signal generator 900 of FIG. 11 will now be described.

The fourth control signal generator 900 receives the second internal voltage Vint2 from the internal voltage generating circuit 800, senses a level thereof, generates the fifth control signal C5 after a predetermined delay time, and outputs it to the first control signal generator 100. The fifth control signal C5 decides a level of the second control signal C2.

Figure 16:
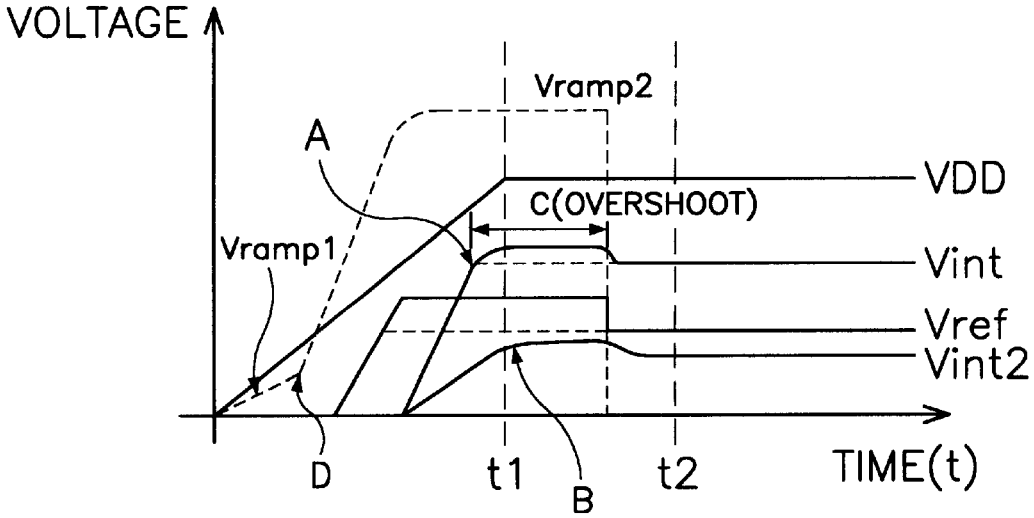
FIG. 16 is a timing diagram of an initial power-up operation in a state where a low external power voltage is supplied to the semiconductor memory device in accordance with the second embodiment of the present invention.

FIG. 16 is a timing diagram of the first and second ramp-up voltages Vramp1 and Vramp2 in the initial power-up operation in a state where the low external power voltage VDD is supplied to the semiconductor memory device.

In FIG. 16, VDD denotes the low external power voltage, Vramp1 and Vramp2 denote the ramp-up voltages generated by using VDD, Vref denotes the reference voltage for internal power generated by receiving Vramp1 and Vramp2, Vint denotes the first internal voltage generated according to Vref, and Vint2 denotes the second internal voltage generated by receiving Vint. A and B respectively represent time points when the first internal voltage Vint and the second internal voltage Vint2 reach an aimed voltage level. C denotes an overshoot period. In the overshoot period, it is possible to remove the delay when Vint2 is generated from Vint. D denotes a time point when the first ramp-up voltage Vramp1 is disabled and replaced by the second ramp-up voltage Vramp2.

As illustrated in FIG. 16, when the low external power voltage VDD is supplied to the semiconductor memory device, the first and second ramp-up voltages Vramp1 and Vramp2 higher than the low external power voltage VDD are generated in the power-up operation, thereby preventing the delay of the internal voltage generation. Therefore, the reference voltage Vref for internal power is generated by using the first and second ramp-up voltages Vramp1 and Vramp2, the first internal voltage Vint is generated by using the reference voltage Vref, the second internal voltage Vint2 is generated by using the first internal voltage Vint. As a result, the reference voltage Vref and the first and second internal voltage Vintl and Vint2 are generated within the aimed voltage reaching time t2 (t1 denotes a time when the low external power voltage VDD reaches an aimed voltage level, and t2 denotes a specification value of the time when the second internal voltage Vint2 reaches an aimed voltage level).

Figure 17:
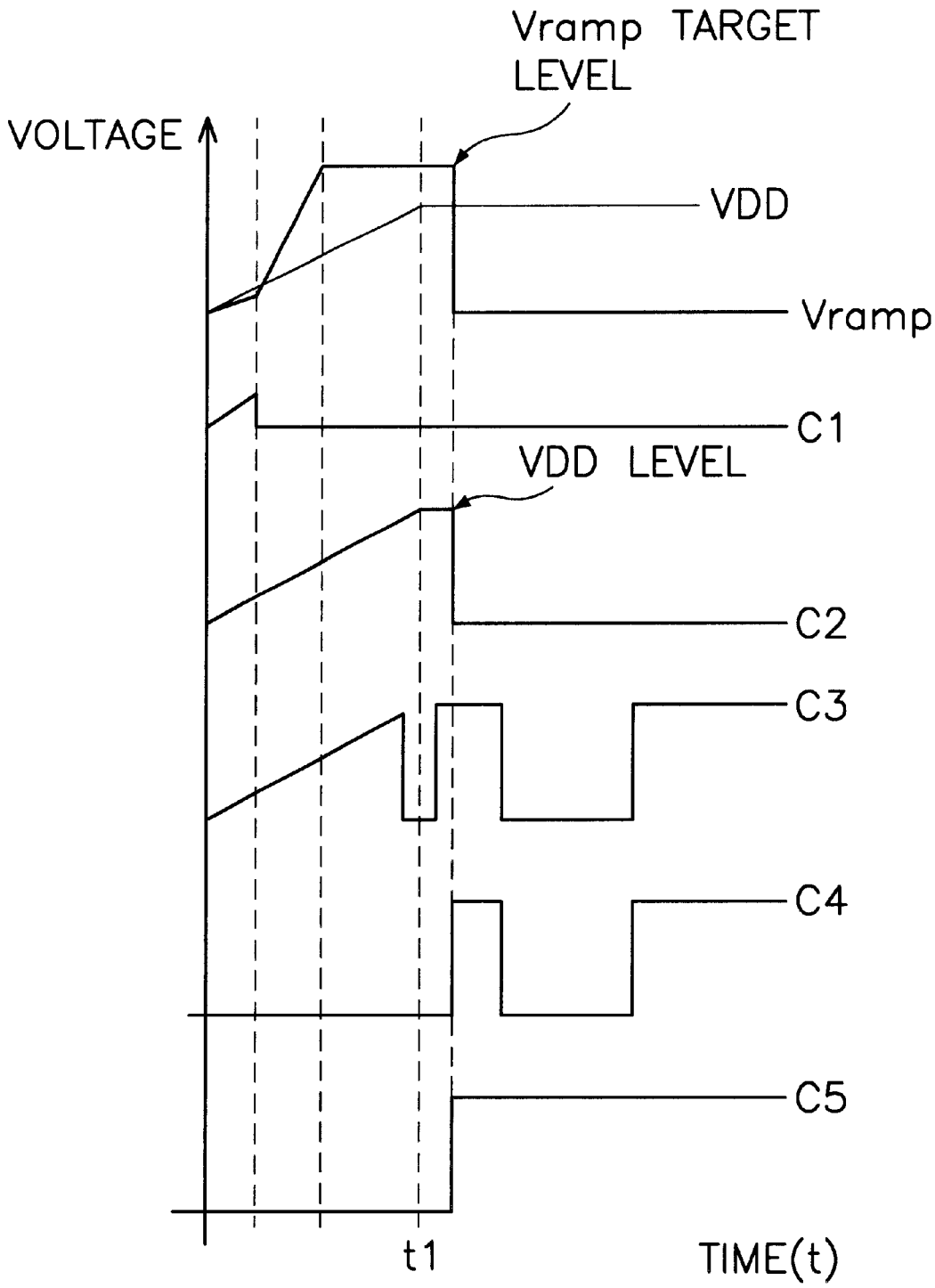
FIG. 17 is a timing diagram of major signals of FIG. 11.

FIG. 17 is a timing diagram of the major signals of FIG. 11.

As depicted in FIG. 17, the second control signal becomes a low level with a predetermined delay (margin) after the level of Vint2 reaches an aimed level. The first and second ramp-up voltages Vramp1 and Vramp2 higher than the low external power voltage VDD are generated by using the first to fifth control signals C1, C2, C3, C4 and C5. The internal voltages Vref, Vint, Vint2 are generated by using the first and second ramp-up voltages Vramp1 and Vramp2, thereby preventing the delay due to the low level.

As discussed above, in accordance with the present invention, when the low external power voltage is supplied to the semiconductor memory device, the reference voltage Vref for internal power is generated within the aimed voltage reaching time t1 by using the ramp-up voltage higher than the low external power voltage generated in the power-up operation, and the first and second internal voltages Vint and Vint2 are generated within the aimed voltage reaching time t2 by using the reference voltage Vref for internal power, thereby removing the delay due to the low voltage. As a result, the whole system can be stably operated.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. An internal voltage generator for a semiconductor memory device, comprising:

a control signal generating means for generating first and second control signals for controlling generation of a ramp-up voltage;

a ramp-up voltage generating means for generating a ramp-up voltage higher than a low external power voltage in response to the first and second control signals;

a switching means for selectively transmitting either the ramp-up voltage or the low external power voltage in response to the second control signal; and an internal voltage generating circuit for selectively receiving either the ramp-up voltage or the low external power voltage from the switching means, and generating a plurality of internal voltages.

2. The generator according to claim 1, wherein the control signal generating means comprises:

a first control signal generating unit for generating the first control signal for controlling generation of the ramp-up voltage by using the low external power voltage; and a second control signal generating unit for generating the second control signal for controlling generation of the ramp-up voltage by using the internal voltage.

3. The generator according to claim 2, wherein the first control signal generating unit comprises:

a first transistor having its source connected to the low power voltage, and its gate and drain commonly connected with each other;

a second transistor having its source connected to the gate and drain of the first transistor, its drain connected to a first node, and its gate connected to a ground voltage;

a third transistor having its source connected to the ground voltage, its gate and drain commonly connected, and its drain connected to the first node;

a first capacitor connected between the first node and the ground voltage;

a latch circuit connected between the first node and a second node;

a second capacitor connected between the second node and the low power voltage; and a plurality of inverters connected between the second node and an output terminal, and outputting the first control signal.

4. The generator according to claim 2, wherein the second control signal generating unit comprises:

a first transistor having its source connected to the internal voltage, and its gate and drain commonly connected;

a second transistor having its source connected to the gate and drain of the first transistor, its drain connected to a first node, and its gate connected to a ground voltage;

a third transistor having its source connected to the ground voltage, its gate and drain commonly connected, and its drain connected to the first node;

a first capacitor connected between the first node and the ground voltage;

a latch circuit connected between the first node and a second node;

a second capacitor connected between the second node and the internal voltage;

a plurality of inverters for inverting a signal of the second node; and a level shifter for level-shifting an output signal from the plurality of inverters and generating the second control signal.

5. The generator according to claim 1, wherein the ramp-up voltage generating means comprises:

a switching device for shorting the ramp-up voltage to the low external power voltage in response to the first control signal;

an oscillator operated in response to the second control signal; and a pump circuit for pumping an output signal from the oscillator to increase the ramp-up voltage over the low external power voltage.

6. The generator according to claim 5, wherein the switching device is an NMOS transistor having its source connected to the low external power voltage, and its gate connected to receive the first control signal.

7. The generator according to claim 1, wherein the switching means comprises:

a first transmission gate switched according to the second control signal, and transmitting the ramp-up voltage; and a second transmission gate switched according to the second control signal, and transmitting the low external power voltage.

8. The generator according to claim 1, wherein the switching means transmits the ramp-up voltage when the second control signal is at a high level, and transmits the low external power voltage when the second control signal is at a low level.

9. An internal voltage generator for a semiconductor memory device, comprising:

a first control signal generating means for generating first and second control signals for controlling generation of a first ramp-up voltage;

a second control signal generating means for generating a third control signal for controlling generation of a second ramp-up voltage and a high voltage;

a third control signal generating means for receiving and synthesizing the second control signal and the third control signal, and generating a fourth control signal for controlling generation of the second ramp-up voltage and the high voltage;

a first ramp-up voltage generating means for generating the first ramp-up voltage higher than the low external power voltage in response to the first control signal;

a second ramp-up voltage generating means for generating the second ramp-up voltage higher than the low external power voltage and the high voltage in response to the second control signal and the fourth control signal;

a first switching means switched according to the second control signal, and selectively transmitting either the second ramp-up voltage or the high voltage;

a second switching means switched according to the second control signal, and selectively transmitting either the first and second ramp-up voltages or the low external power voltage;

an internal voltage generating circuit for selectively receiving either the first and second ramp-up voltages or the low external power voltage from the second switching means and generating a plurality of internal voltages; and a fourth control signal generating means for receiving one of the plurality of internal voltages and generating a fifth control signal for deciding a level of the second control signal.

10. The generator according to claim 9, wherein the third control signal generating means comprises:

an inverting device for inverting the third control signal; and a logical device for logically combining an output signal from the inverting device and the second control signal, and generating the fourth control signal.

11. The generator according to claim 9, wherein the first ramp-up voltage generating means comprises an NMOS transistor for generating the first ramp-up voltage higher than the low external power voltage in response to the first control signal.

12. The generator according to claim 9, wherein the second ramp-up voltage generating means exclusively use a regulator for high voltage and a pump.

13. The generator according to claim 9, wherein the first switching means comprises:

an inverting device for inverting the second control signal; and first and second transmission gates switched according to the second control signal and an output signal from the inverting device, and selectively transmitting either the second ramp-up voltage or the high voltage.

14. The generator according to claim 9, wherein the second switching means comprises:

an inverting device for inverting the second control signal;

a first transmission gate switched according to the second control signal and an output signal from the inverting device, and selectively transmitting the first and second ramp-up voltages; and a second transmission gate switched according to the second control signal and an output signal from the inverting device, and for transmitting the low external power voltage.

* * * * *